United States Patent [19]

Palac

[11] Patent Number: 4,701,666

[45] **Date of Patent: * Oct. 20, 1987**

[54] GROOVE AND BALL REGISTRATION SYSTEM FOR A CRT FLAT PANEL

[75] Inventor: Kazimir Palac, Carpentersville, Ill.

[73] Assignee: Zenith Electronics Corporation, Glenview, Ill.

[ * ] Notice: The portion of the term of this patent subsequent to Oct. 15, 2002 has been disclaimed.

[21] Appl. No.: 693,078

[22] Filed: Jan. 22, 1985

[51] Int. Cl.[4] ..... H01J 29/81; H01J 29/86

[52] U.S. Cl. ..... 313/407; 313/477 R

[58] Field of Search ..... 313/407, 477 R

[56] References Cited

U.S. PATENT DOCUMENTS 2,961,560 11/1960 Fyler ..... 313/408 X 4,547,696 10/1985 Strauss ..... 313/407

*Primary Examiner*—Palmer C. DeMeo

[57] ABSTRACT

A flat panel tensed foil shadow mask registration system includes three radially disposed grooves on the panel and three oppositely disposed grooves on the frame that supports the tensed mask. Three spherical balls serve to align the panel and the frame in a precise relationship. The balls are permitted to roll in the grooves and one of the grooves in each pair is shorter than the other to restrict the range of positions of the ball in the other groove of each pair when the panel and frame are in the precise relationship.

9 Claims, 11 Drawing Figures

FIGURE 4
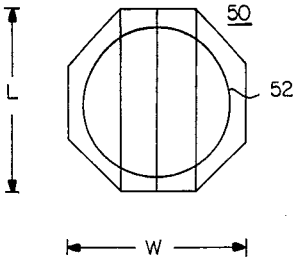
FIGURE 7
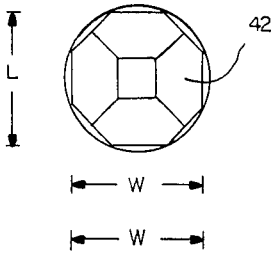
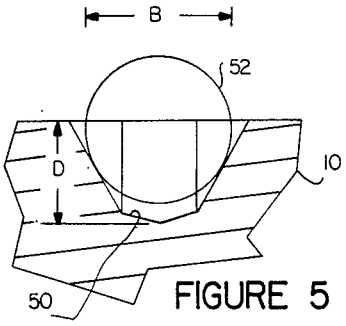
FIGURE 5
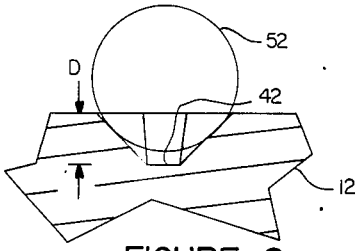
FIGURE 8
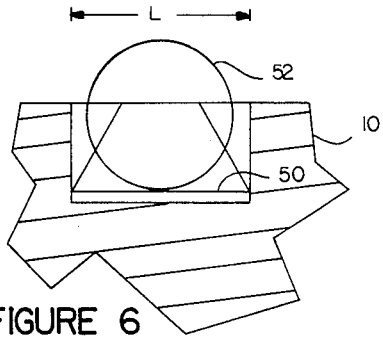
FIGURE 6
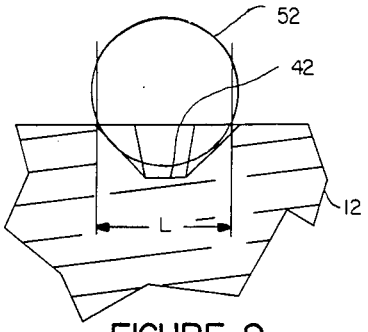
FIGURE 9
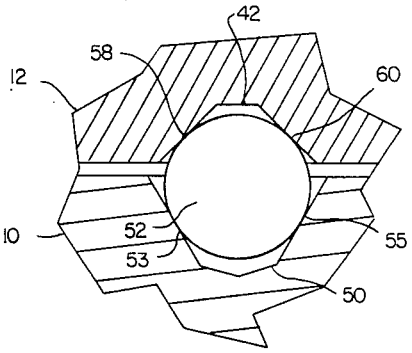
FIGURE 10
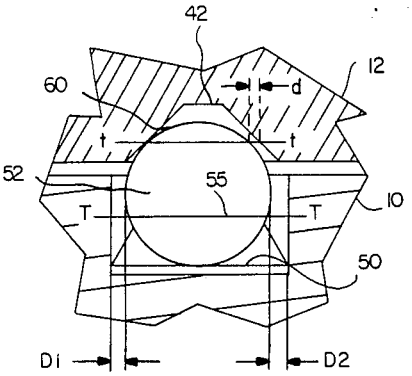
FIGURE 11

GROOVE AND BALL REGISTRATION SYSTEM FOR A CRT FLAT PANEL

CROSS REFERENCE TO RELATED PATENT APPLICATIONS

This invention is related to subject matter disclosed in copending applications, Ser. No. 538,001 filed Sept. 30, 1983 in the name of Kazimir Palac, now U.S. Pat. No. 4,593,224, and Ser. No. 572,088 filed Jan. 18, 1984 in the name of Paul Strauss, now U.S. Pat. No. 4,547,696, both of which are assigned to Zenith Electronics Corporation and both of which are hereby incorporated by reference.

BACKGROUND OF THE INVENTION AND PRIOR ART

This invention relates generally to registration systems and particularly to registration systems useful in connection with the manufacture of cathode ray tubes (CRTs) characterized by a flat panel and a shadow mask consisting of a thin, tensed foil.

The shadow mask type of color picture tube has given statisfactory performance for many years. The shadow mask used in such picture tubes is generally spherical, self supporting and, of necessity, has substantial thickness. In the above-mentioned copending applications a different type of color tube construction is described. In the disclosed constructions, a flat glass panel faceplate has a tensed foil mask maintained in close registration thereto for selectively shadowing elemental ones of a plurality of triads of colored light-emitting phosphors deposited in an ordered pattern on the inner surface of the panel. The mosaic of elemental phosphors, called the target or screen, is generally formed by a photodeposition process utilizing the shadow mask and a light source that simulates the electron beam in the CRT. The assemblage is removably positioned in precise alignment through the use of registration means formed in each of the panel seal land, the seal land of the frame that supports the shadow mask and the seal end of the tube funnel. Precise registration is required during screening of the target of the faceplate. In a well-known screening process each pattern of different colored light emitting phosphors and a "black surround" or grille requires precise repositioning of the mask. Thus the need for an accurate registration system is paramount.

The above mentioned Strauss patent describes a ball and two-groove registration system system for a flat panel CRT. There, three radially disposed V-sided grooves are formed in the panel seal land in a confronting relation with three similar radially disposed V-sided grooves formed in the frame seal land. The so-called "Q" spacing between the tensed mask and the phosphor target on the panel is maintained by three balls of given diameter and sphericity, each co-pending with one of the pairs of grooves. The balls and grooves provide a minimum friction kinematic mount for repeatedly returning the mask and panel to the same geometric orientation with respect to each other. As those skilled in the art will readily perceive, the balls may occupy an "infinite" number of positions along their grooves and still retain the appropriate geometric registration required. The essential teaching of the Strauss patent is to permit the balls the freedom to roll to minimize friction and maximize the opportunity for the frame and panel, and hence the mask and target, to achieve proper registration.

The grooves may be formed in the glass pieces by any number of techniques, preferably by ultrasonic drilling. Since it is desired to maintain a reseating accuracy of 0.0002 inches, it can readily be appreciated that the need for accurate machining of the grooves in the glass pieces cannot be overemphasized. Imperfections in the sidewalls of the grooves may result in a change in the "Q" distance between the mask and target, causing misregistration between the phosphor target and the mask. Since the target is formed by a screening process using the mask as an exposure element, sidewall inaccuracies may be tolerated if they are consistently repeated. Since repeatability of registration is essential, it is highly desirable to provide a system wherein the balls would be assured of rolling movement and yet be restricted in their range of travel so as to relax the requirements on imperfections in the groove sidewalls.

OBJECTS OF THE INVENTION

A principal object of this invention is to provide a novel registration system for a CRT.

Another object of this invention is to provide a registration system with a high degree of repeatability with a lessened need for precise machining tolerances.

A further object of the invention is to provide an improved registration system for a flat panel CRT featuring a tensed foil mask.

BRIEF DESCRIPTION OF THE DRAWINGS

These and other objects of the invention will be apparent upon reading the following description in conjunction with the drawings in which:

FIGS. 4, 5 and 6 are plan, end and side views, respectively, of the larger one of a pair of registration grooves;

FIGS. 7, 8 and 9 are similar plan, end and side views of the smaller one of a pair of registration grooves; and FIGS. 10 and 11 are end and side views of groove 50 and groove 42 views, respectively, showing a seated ball and the grooves providing registration in accordance with the invention.

DESCRIPTION OF THE PREFERRED EMBODIMENT

Figure 1:
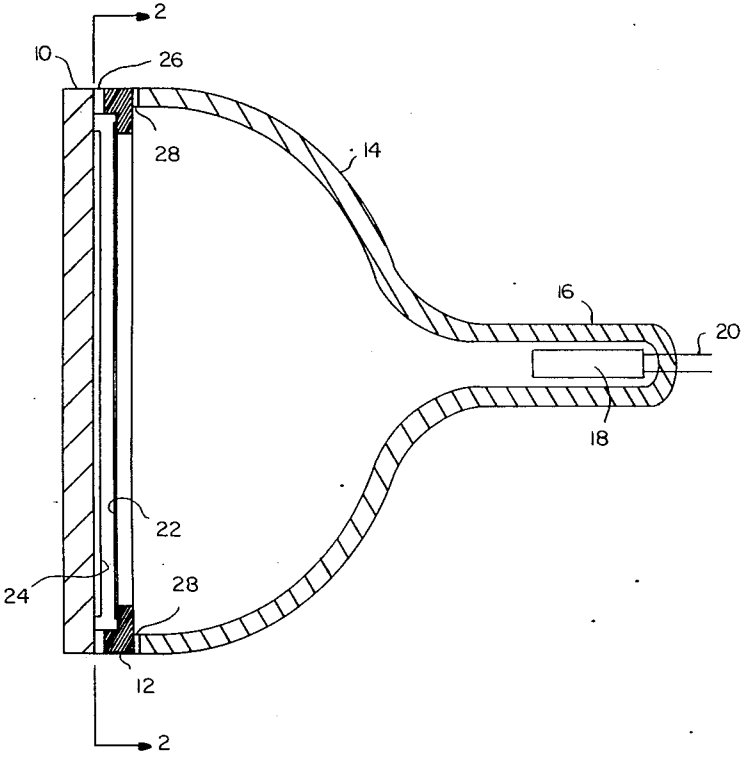
FIG. 1 is a diagrammatic cross section of a flat panel CRT to which the invention is especially applicable.

Referring to FIG. 1, a flat glass panel 10 of a CRT includes on the inner surface thereof a target 24 conventionally consisting of a regular pattern of elemental colored light-emitting phosphors arranged in clusters, or triads, each comprising a red, blue and green phosphor element. Positioned adjacent to target 24 is a flat shadow mask 22 which, as is well known in the art, includes a plurality of apertures for masking or shadowing different ones of the elemental color phosphors in target 24 from all but its assigned one of a plurality of electron beams emitted from a gun structure 18 located in an elongated neck 16 of the CRT. Mask 22 is maintained in position adjacent target 24 on the inner surface of panel 10 by a frame 12 the forwardly directed surface of which is sealed to panel 10 by glass "frit" 26. A generally bell-shaped funnel 14 completes the CRT. The funnel has its open end sealed to the opposite or rearwardly directed, surface of frame 12 by frit 28 while its other end is terminated by neck 16. A number of electrode pins 20 enable electrical operating and signal potentials to be applied to various elements of gun 18. The CRT includes other, well-known, elements such as a high voltage anode button, an internal magnetic shield and a gun supporting structure, all of which have been omitted for the sake of clarity.

Figure 2:
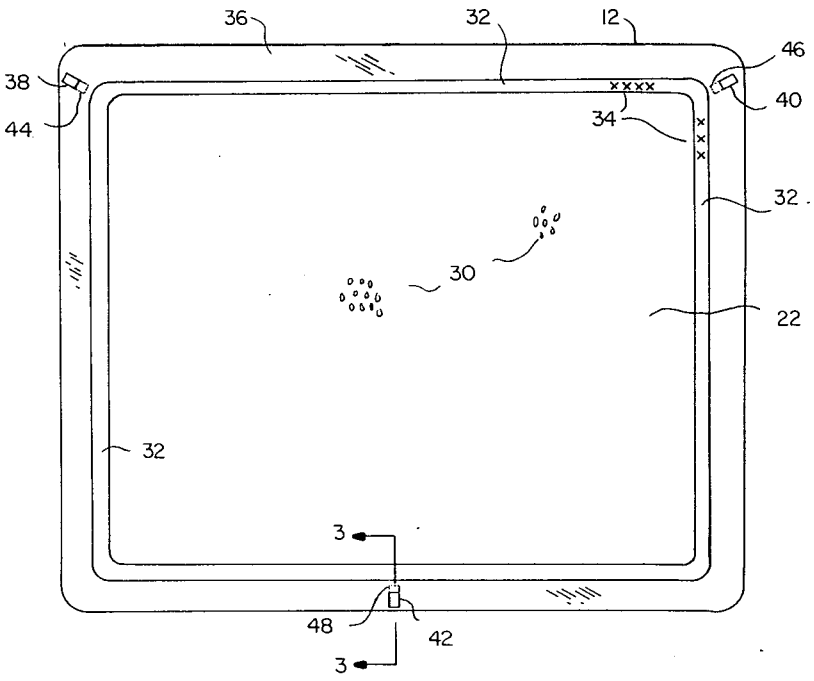
FIG. 2 is a plan view of the tensed foil mask and supporting frame of the CRT in FIG. 1.

In FIG. 2, the generally rectangular configuration of frame 12 is seen. The surface of shadow mask 22 defines a plurality of apertures 30, only a few of which are shown, which shadow the phosphor triads mentioned above. Frame 12 has an inner annular recess 32 upon which the peripheral edges of the tensed mask 22 are secured, as indicated by 34. As described in the copending applications above, the edges of the shadow mask may be frit-bonded to the glass or ceramic frame under tension by taking advantage of the difference in temperature coefficients of expansion of the metal mask and the glass frame. Of course, mask 22 may be mounted, under tension, to frame 12 by other means as well.

Frame 12 has three registration grooves 38, 40 and 42 formed in the surface or seal land 36 juxtaposed to or confronting panel 10. The frame also includes three registration grooves 44, 46 and 48 substantially behind grooves 38, 40 and 42, respectively, on its obverse surface 13, that is the surface that confronts the funnel 14 of the CRT, see FIG. 3. As is fully taught in the referenced '244 and '696 patents, the registration grooves are preferably V-shaped radially disposed with respect to the center of mass of the panel and of the frame, with the funnel being aligned with the axis of its neck perpendicular to the panel and passing through the center of mass. The radial relationship of the grooves yields an added advantage in the event of differential expansion between the panel and frame. The grooves are arranged in line (one above the other) so as to support all parts without stress.

Figure 3:
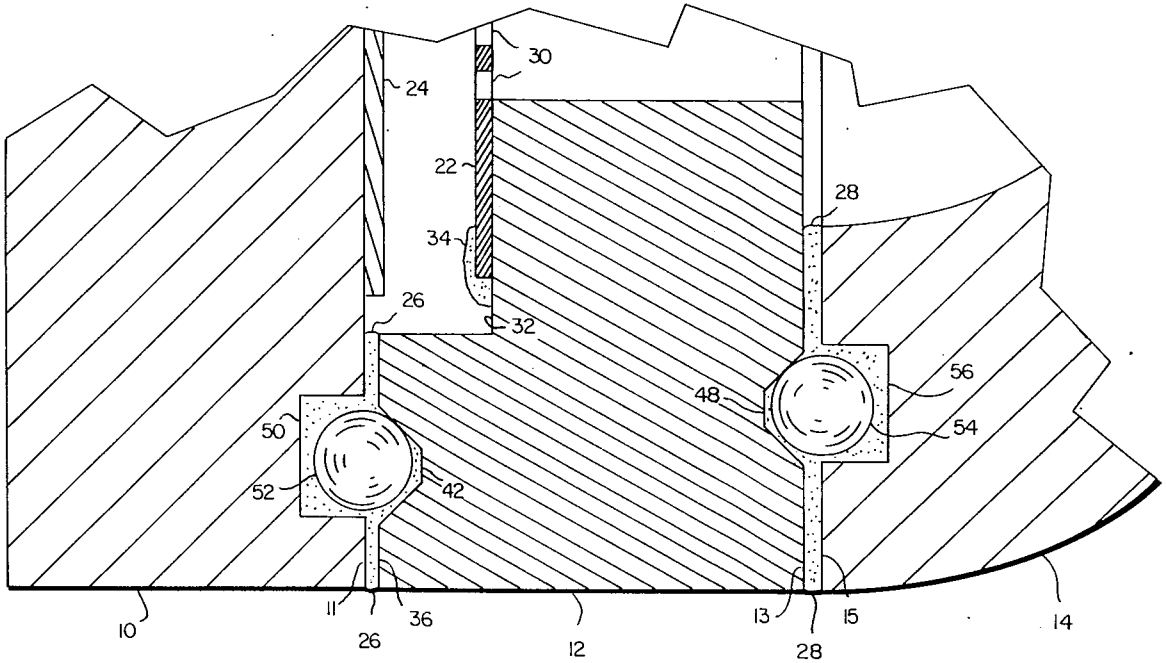
FIG. 3 is an enlarged sectional view through one of the panel-frame registration means taken along lines 3—3 of FIG. 2.

Referring to FIG. 3, an enlarged partial cross section through the assembled CRT along lines 3—3 of FIG. 2, there is illustrated the frit-joined ball and registration groove assembly. Registration groove 50 in panel 10 is seen to be longer and deeper than registration groove 42 in frame 12. While not shown in FIGS. 1–3, panel 10 is provided with two additional grooves, one confronting frame groove 38 and one confronting frame groove 40, see the referenced Palac or Strauss patents. The groove dimensions and configurations are also such that ball 52 rides more deeply in groove 50 than in groove 42. The dimensions of the grooves and the ball are selected to provide a predetermined frit seal gap between seal land 11 of panel 10 and seal land 36 of frame 12. The ball and groove dimensions also determine the "Q" distance between target 24 and shadow mask 22, which is supported on recess 32 of frame 12 as illustrated. It should be appreciated that it is this "Q" distance, as well as the transverse alignment of mask 22 with respect to target 24, that is critical for proper color registry in the CRT. The spaces between seal lands 11 and 36, and those defined by grooves 50 and 42 and by ball 52, are also filled with frit 26. As is well known, devitrifying frit consists of a paste of ground-up glass that, when heated, melts and crystallizes over a period of time at high temperature, i.e. 435 degress for ½ hour. The frit becomes a ceramic-like material after crystallizing.

The registration between the frame and the funnel is not nearly as critical as registration between the panel and the frame. However, proper registration in this area assists in positioning the electron gun on the axis of the CRT and enhances the performance of the finished CRT. Consequently, a similar long groove 56 formed in the seal land 15 of funnel 14 and a short groove 48 on the observed side 13 of frame 12 are used with a ball 54 interposed therebetween. Here again, frit 28 surrounds ball 54 and fills the intervening spaces between seal lands 13 and 15 and grooves 48 and 56. While the dimensions of the ball and grooves in the funnel-to-frame registration means need not be the same as the dimensions in the panel-to-frame registration means, obvious manufacturing simplications flow from their having the same dimensions.

In FIGS. 4 through 9, the plan views, side views and end views of the two different size grooves are shown. A ball is superimposed to illustrate the general relationship between the ball diameter and groove dimensions. As best illustrated in FIGS. 5 and 8, the ball is constrained by the sidewalls of the grooves and is therefore not free to roll in that direction. The ball can only roll along the long dimension of the groove. It will be noted particularly with respect to FIGS. 4 through 6 (illustrating a long groove) that ball 52 is permitted to travel a substantial distance along the length of the groove. On the other hand, as FIGS. 7 through 9 clearly illustrate, ball 52 is permitted only very limited travel in the short groove. For minimum friction, which is necessary for the balls to seat completely in the groove, ball 52 must be free to roll rather than being "rubbed" along the groove wall. The long groove permits needed manufacturing and processing tolerances between the panel and frame members, while also assuring a unique, repeatable registration between these members. The short groove restricts the range of positions that the balls may occupy in the long grooves in achieving the unique registration during the repeated mating and unmating of the panel and frame during the screening and other processing steps of CRT manufacture. Any imperfections encountered in the groove walls are thus more likely to be encountered again whenever the panel and frame are assembled. As is well known, the photodeposition technique for screening the CRT target compensates for such imperfections and, as long as the imperfections are consistent, the CRT is affected only slightly. However, permitting a greater range of travel for the balls increases the likelihood that any imperfections in the groove walls will be encountered again and the potential for misregistration therefore increases. Using grooves of different dimensions as taught herein thus greatly enhances registration precision.

FIGS. 10 and 11 show end and side cross-sections of assembled groove and ball registration systems to more clearly illustrate the features of the invention. In FIG. 10, which is an end view of the grooves, ball 52 contacts long groove 50 at tangent points 53 and 55. On the other hand, ball 52 contacts the walls of short groove 42 at tangent points 58 and 60. In FIG. 10 the only movement permitted by ball 52 is seen to be toward and away from the plane of the figure. In FIG. 11, ball 52 is seen to have substantial freedom of movement along line T—T, which includes tangent point 55. The total movement permitted is indicated by "D1" plus "D2". On the contrary, and also as seen in FIG. 11, ball 52 is allowed only limited movement along line t—t, which includes tangent point 60, in short groove 42 as illustrated by the distance "d".

Thus, with the three ball registration system of the invention, each ball is permitted very limited rolling movement in its short groove which thereby confines its range of positions in its associated long groove when registration between parts is effected. Consequently, during repeated mating of the panel and frame, the distance over which each ball may travel in its long groove is substantially restricted and any imperfection in the groove walls is likely to be encountered during each mating (and processing step) and thus, effectively assure the same "Q" dimension between the panel and the frame when in registration.

It will be understood that specific dimensions of the grooves, the angles of the groove walls and the diameters of the balls, as well as the frit seal distance, will be, in part, dependent upon the size of the CRT and the designer's choice as well as whether the registration system is to be included as part of the seal land or not. The following dimensions should therefore be considered representative only. The CRT selected as being representative has a 12" diagonal panel. The typical long groove is 0.233 inches long, reference L in FIGS. 4 and 6, 0.226 inches wide, reference W in FIG. 4 and has an overall depth of 0.147 inches, reference D in FIG. 5. The ball diameter is 0.188 inches, reference B in FIG. 5. A typical short groove measures 0.046 inches by 0.038 inches for the rectangle formed at its bottom, see FIG. 7, with overall dimensions being 0.175 inches long, reference L in FIGS. 7 and 9, by 0.166 inches wide, reference W in FIGS. 7 and 8. The depth of the groove, reference D in FIG. 8, is about 0.065 inches. These dimensions will achieve a frit gap of 0.015 inches and permit travel of about 0.045 inches in the long groove and 0.088 inches in the short groove.

It is recognized that numerous modifications and changes in the described embodiment of the invention will be apparent to those skilled in the art without departing from the true spirit and scope thereof. The invention is to be limited only as described in the claims.

What is claimed is:

1. A registration system for a color television picture tube comprising:

a flat glass panel adapted to receive on a surface thereof a target consisting of a mosaic of elemental colored light-emitting phosphors arranged in a predetermined pattern for selective excitation by a plurality of electron beams;

a shadow mask including a pattern of apertures for shadowing different ones of said elemental phosphors from electron beams emitted from displaced sources when said shadow mask is in a defined position between said sources and said target;

a frame for supporting and shadow mask;

two sets of three nonparallelly disposed grooves, having substantially V-shaped cross sections, one of said sets being associated with said frame and the other said set being associated with said panel to form three pairs of opposed grovoes in facing relationship when said panel and said frame are juxtaposed to each other, each of said grooves having a predetermined length, width and depth, one of said grooves in each said pair of opposed grooves having a length shorter than the length of the other of said grooves in said pair; and three spherical members, individually positioned in an assigned one of said three pairs of opposed grooves, respectively, whereby said frame and said panel may be positioned with respect to each other with a precise repeatable registration between said target and said mask and, whereby, each of said spherical members is permitted rolling movements over limited paths within its assigned pair of opposed grooves when said frame and said panel are positioned with respect to each other.

2. The registration system of claim 1 wherein said spherical members are permitted rolling movements of approximately 0.008 inches in said shorter grooves.

3. The registration system of claim 2 wherein said sets of grooves are formed in said panel and in said frame.

4. The registration system of claim 3 wherein said grooves in said panel are formed in the frit seal land between said panel and said frame and wherein said shadow mask comprises a tensed foil supported on said frame and spaced a distance therefrom determined by the shape of said grooves and the diameter of said spherical members.

5. The registration system of claim 4 wherein said grooves are radially aligned with respect to the centers of mass of said panel and of said frame.

6. The registration system of claim 5 wherein said frame comprises a glass-like material that may be bonded to said panel by a glass-like material.

7. The registration system of claim 6 wherein said glass-like bonding material is a devitrifiable frit and wherein said ball is surrounded by, and said grooves are filled with, said devitrifiable frit.

8. A registration system for a television picture tube comprising a flat glass panel adapted to receive on the inner surface thereof a target consisting of a mosaic of elemental colored light-emitting phosphors arranged in a predetermined pattern for selective excitation by a plurality of electron beams;

a tensed foil shadow mask including a pattern of apertures for shadowing different ones of said elemental phosphors from electron beams emitted from displaced sources when said shadow mask is in a defined position between said sources and said target;

a frame for supporting said shadow mask;

three radially disposed substantially V-shaped grooves formed in each of said frame and said panel and defining three pairs of opposed grooves in facing relationship when said panel and said frame are juxtaposed to each other, each of said grooves having a predetermined length, width and depth;

three balls, individually positioned in an assigned one of said pairs of opposed grooves; and one of the grooves in each said pair of opposed grooves having a length shorter than the length of the other end and permitting only limited rolling movements of said ball within its asssigned pair of opposed grooves, whereby said frame and said panel may be repeatedly positioned with respect to each other with a precise registration between said target and said mask and whereby the range of possible positions of said balls in the longer of each of said pair of grooves is restricted by the limited travel available in the shorter grooves.

9. The registration system of claim 8 wherein said frame and said balls are each made of glass.

* * * * *